United States Patent [19]

Sun

[11] Patent Number: 4,872,685

[45] Date of Patent: Oct. 10, 1989

[54] GOLF CLUB HEAD WITH IMPACT INSERT MEMBER

[76] Inventor: Donald J. C. Sun, 4521 Ocean Valley La., San Diego, Calif. 92130

[21] Appl. No.: 270,508

[22] Filed: Nov. 14, 1988

[51] Int. Cl.[4] ..... A63B 53/04

[52] U.S. Cl. ..... 273/169; 273/173

[58] Field of Search ..... 273/167 R–175, 273/77 A, 77 R, 72 A, 194 R, 194 B, 193 R

[56] References Cited

U.S. PATENT DOCUMENTS

| | | | |
|---|---|---|---|
| 1,509,429 | 9/1924 | Hillerich | 273/172 |
| 1,616,920 | 3/1927 | Pedersen | 273/169 |
| 3,912,277 | 10/1975 | Pelz | 273/171 |
| 3,962,306 | 9/1972 | Glover | 273/172 |
| 4,021,047 | 5/1977 | Mader | 273/167 H |
| 4,121,832 | 10/1978 | Ebbing | 273/173 |
| 4,695,054 | 9/1987 | Tunstall | 273/167 H |

*Primary Examiner*—Edward M. Coven
*Assistant Examiner*—S. Passaniti
*Attorney, Agent, or Firm*—Edward A. Sokolski

[57] ABSTRACT

A golf club driver or "wood" head is formed by interlocking female and male units. The female unit provides the basic shape of the head while the male unit which is inserted into the female unit to complete the club head structure includes the sole plate, face plate, and central and back weight elements. The male unit has a substantially greater weight than the female unit and forms a hammer-like impact member to provide a maximum power transfer from the head to the ball. The side walls of the central weight element of the male unit has recesses formed therein which fit around ribs formed in the female unit in interlocking engagement therewith so that when the two units are joined together by means of screws and/or cementing, a unitary structure is formed which gives the head a solid feel on impact.

6 Claims, 2 Drawing Sheets

GOLF CLUB HEAD WITH IMPACT INSERT MEMBER

This invention relates to golf club heads and more particularly to a driver or "wood" head which is formed from interlocking male and female units.

In the design of driver or "wood" golf club heads it is important that on impact the club head has a "sweet" or solid feel. It is generally felt that a very low center of gravity is helpful in this regard, i.e. to concentrate the head weight as close to the sole plate as possible. A further important consideration is the reduction of the torque on the club shaft during strong downward swing and impact. This can be achieved by concentrating the weight along an extension to the axis of the shaft of the club and reducing the weight in the toe portion of the head. A further consideration in improving the characteristics of a club head is to evenly distribute the perimeter weight of the head which provides greatest stability during impact. Another factor is the strengthening of the face construction of the head in view of the fact that the provision of a solid feeling at the face, on impact, is a significant factor in improving the effectiveness of the club. This end result can be achieved by providing reinforcement behind the face plate along with substantial weighted support in this area.

In attempting to achieve the above indicated end results, certain prior art driver or "wood" heads have been designed in two pieces with the main structure of the head being fabricated of metal. In U.S. Pat. No. 4,021,047 to Mader, a driver club is described which is formed from a one piece casting which includes a face plate portion, a sole plate portion and toe and heel portions with a concave center. In the club head of this patent, a cap is fitted onto the casting to form a hollow chamber in the center of the club head. In U.S. Pat. No. 1,616,920 to Pedersen, a driver head is described which has a metal head with an enlarged cavity formed therein in which a resilient insert is installed.

The golf club head of the present invention, as in the aforementioned prior art patents, is formed from a pair of units which are joined together to form a unitary structure. In the present invention, however, there is an improved structure which provides a more solid feel, such structure being constructed from male and female units which are fitted together in interlocking relationship to form a solid unitary club head.

Briefly described, the club head of the present invention is formed from a male unit, preferably made of a light metal alloy which includes the sole plate, face plate and central and back weight elements. This male unit fits into a female unit in mating engagement therewith, the female unit providing the outer body and the basic shape of the head. This female unit is preferably formed from a material such as a suitable plastic, carbon alloy or wood. The male and female units fit together in interlocking engagement with each other and are held together by screws and bonding cement to form a unitary solid structure, the male unit having a substantially greater weight than that of the female unit to provide the desired optimum weight concentrations for a "sweet" feel.

It is therefore an object of this invention to provide an improved golf club driver or "wood" head having a better "sweet" feel.

It is a further object of this invention to provide an improved golf club driver or "wood" head formed from interlocking male and female units.

Other objects of the invention will become apparent as the description proceeds in connection with the accompanying drawings of which:

Referring now to the Figures, the preferred embodiment of the invention is illustrated. The club head is formed from a male unit 11, which is matingly fitted into a female unit 12. The female unit which forms the main body of the club head is preferably formed from a suitable plastic, carbon alloy or wood while the male unit 11 is preferably formed from a light metal alloy such as aluminum alloy, beryllium copper or titanium alloy. The two units are joined together by means of screws 14 and a suitable epoxy cement so that they form a solid integral assembly.

Figure 1:
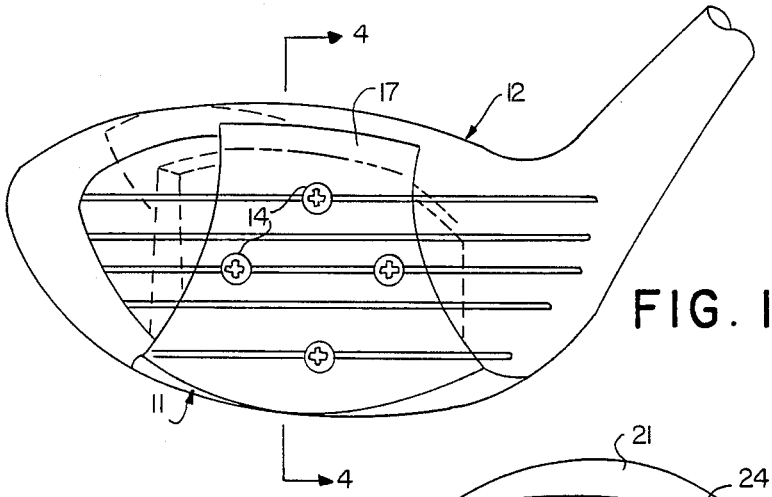
FIG. 1 is a side elevational view of a preferred embodiment of the invention.
Figure 2:
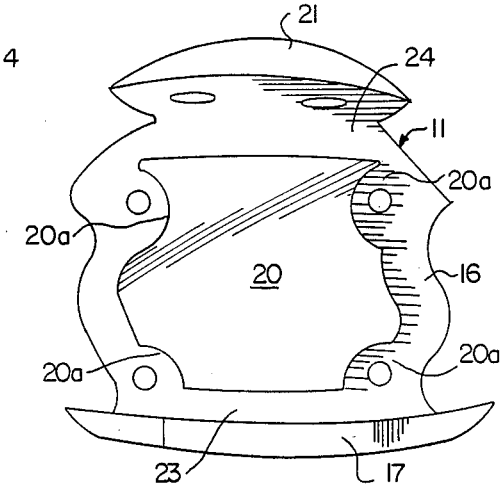
FIG. 2 is a top plan view of the male unit of the preferred embodiment.
Figure 3:
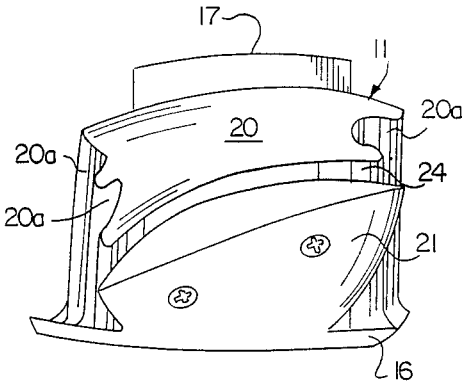
FIG. 3 is a side elevational view of the male unit of the preferred embodiment.
Figure 8:
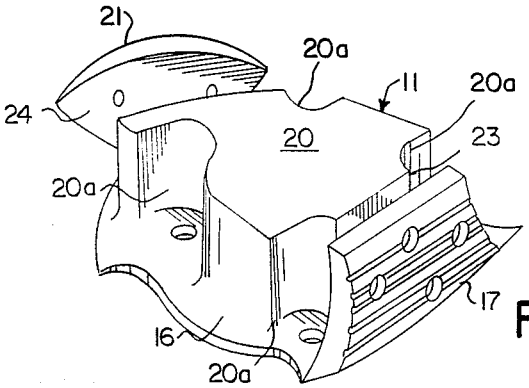
FIG. 8 is a top perspective view of the male unit of the preferred embodiment.

As can best be seen in FIGS. 2, 3 and 8, the male unit includes the sole plate 16 and a face insert forming the face plate 17 of the club head. Also included in the male unit is a central weight element 20 and a rear weight element 21. A slot 23 is formed between face plate 17 and central weight element 20, another slot 24 being formed between rear weight element 21 and central weight element 20. Recesses 20a are formed along the sides of central weight element 20.

Figure 4:
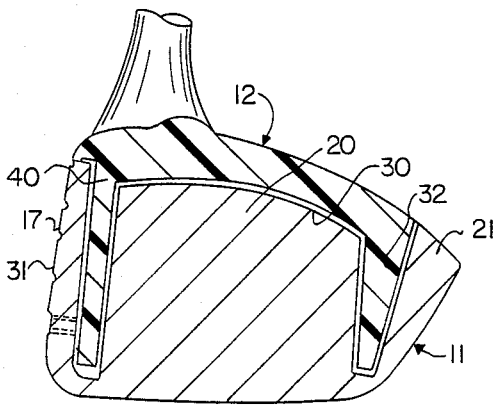
FIG. 4 is a cross sectional view taken along the plane indicated by 4—4 in FIG. 1.
Figure 5:
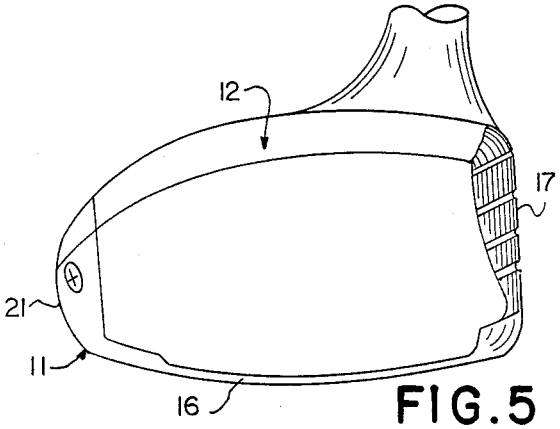
FIG. 5 is a front elevational view of the preferred embodiment.
Figure 7:
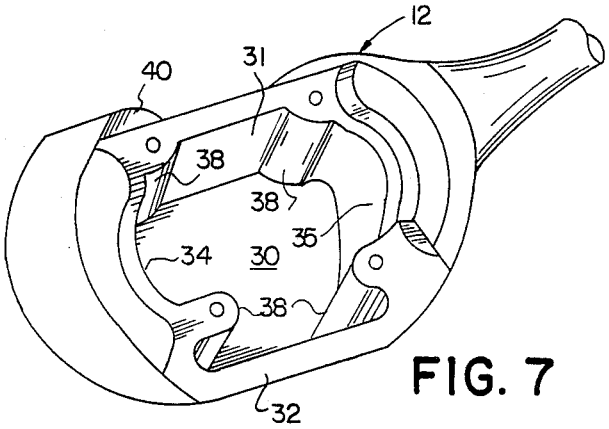
FIG. 7 is a bottom perspective view of the female unit of the preferred embodiment.
Figure 6:
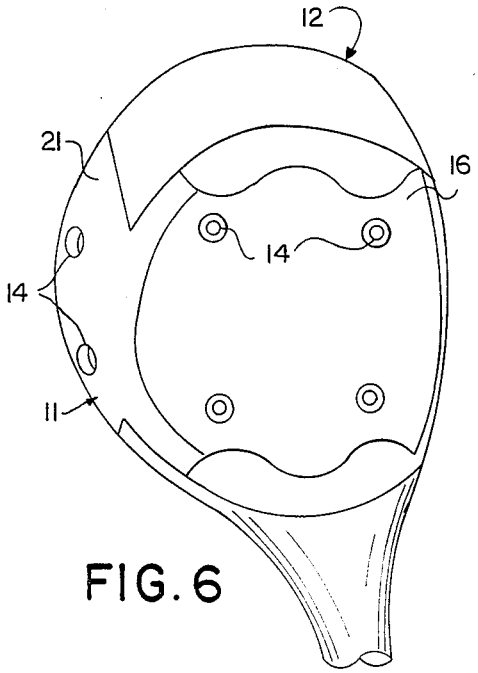
FIG. 6 is a bottom plan view of the preferred embodiment.

The female unit which can best be seen in FIGS. 4 and 7 has a hollow center 30 and a pair of straight sided opposing front and rear walls 31 and 32. Side walls 34 and 35 are curved with ribs 38 being formed between the side walls and the front and rear walls. An undercut portion 40 is formed in the bottom edge of the female unit.

The male and female units are fitted together in mating relationship with face plate 17 fitted within undercut portion 40 of the female unit in abutment against the outer surface of wall 31 and with back weight element 21 abutting against the outer surface of wall 32. Recessed portions 20a of male unit 11 matingly engage rib portions 38 of female unit 12 with the outer walls of central weight elements 20 in mating engagement with the inner surfaces of walls 31, 32, 34 and 35 of female unit 12.

Thus, when joined together the male and female elements form a solid integrated assembly. The weight of the male unit is made substantially greater than that of the female unit to optimize the hitting effect of the club head. Typically, it has been found that a male unit having 1.85–2.35 times the weight of the female unit will give optimum results for most golfers.

While the invention has been described and illustrated in detail, it is to be clearly understood that this is intended by way of illustration and example only and is not to be taken by way of limitation, the spirit and scope of the invention being limited only by the terms of the following claims.

I claim:

1. A golf club head comprising:

a male unit which includes a sole plate for said head, a face plate for said head extending normally from the sole plate, a back weight element extending normally from said sole plate and a central weight element having outer walls extending normally from said sole plate and located between the face plate and back weight element, there being a first slot formed between the central weight element and said back weight element and a second slot formed between the central weight element and said face plate;

a female unit forming the outer body of said club head and including a central hollow portion for receiving the central weight element of the male unit, said hollow portion being formed by a pair of opposing front and rear walls and a pair of opposing side walls, said front wall having an outer surface with an undercut portion for receiving the face plate;

said male and female units being joined together in mating relationship to form an integral assembly with the central weight element of said male unit in mating engagement within the hollow portion of the female unit, the face plate being fitted within the undercut portion of the female unit and abutting against said front wall and the back weight element abutting against the rear wall of said female unit.

2. The club head of claim 1 wherein the front and rear walls of said female unit are fitted within the second and first slots of said male unit respectively.

3. The club head of claim 1 wherein the outer walls of the central weight element have recesses formed therein, said female unit having ribs formed along the side walls of said hollow portions which matingly engage said recesses.

4. The club head of claim 1 wherein said female unit has a weight, said male unit has a weight which is 1.85–2.35 times the weight of said female unit.

5. The club head of claim 1 wherein said female unit has a bottom with an undercut portion in which the sole plate is fitted.

6. The club head of claim 3 wherein the outer walls of said central weight element are curved, the side walls of the hollow portion of said female unit being curved to matingly engage said outer walls of the central weight element.

* * * * *